US006403937B1

(12) United States Patent
Day et al.

(10) Patent No.: US 6,403,937 B1
(45) Date of Patent: Jun. 11, 2002

(54) COMBINATION CONVECTION/ MICROWAVE OVEN CONTROLLER

(75) Inventors: William Day; David Harter, both of New Port Richey, FL (US)

(73) Assignee: The Garland Group, Freeland, PA (US)

( * ) Notice: Subject to any disclaimer, the term of this patent is extended or adjusted under 35 U.S.C. 154(b) by 0 days.

(21) Appl. No.: 09/612,167

(22) Filed: Jul. 8, 2000

(51) Int. Cl.[7] ..... H05B 6/80

(52) U.S. Cl. ..... 219/681; 219/762; 219/746; 219/763; 219/400; 219/718

(58) Field of Search ..... 219/681, 682, 219/685, 746, 748, 750, 762, 756, 763, 400, 757, 718

(56) References Cited

U.S. PATENT DOCUMENTS

| | | | | |
|---|---|---|---|---|
| 3,422,240 A | * | 1/1969 | Parker | 219/750 |
| 3,569,656 A | * | 3/1971 | White et al. | 219/685 |
| 4,283,614 A | | 8/1981 | Tanaka et al. | 219/10.55 R |
| 4,332,992 A | | 6/1982 | Larsen et al. | 219/10.55 R |
| 4,335,290 A | * | 6/1982 | Teich | 219/681 |
| 4,358,653 A | | 11/1982 | Weiss | 219/10.55 |
| 4,366,357 A | * | 12/1982 | Satoh | 219/682 |
| 4,392,038 A | | 7/1983 | Day et al. | 219/10.55 |
| 4,410,779 A | | 10/1983 | Weiss | 219/10.55 |
| 4,430,541 A | | 2/1984 | Day, Jr. | 219/10.55 R |
| 4,661,670 A | * | 4/1987 | Eke | 219/681 |
| 4,691,088 A | * | 9/1987 | Eke | 219/681 |
| 5,814,794 A | * | 9/1998 | Lim | 219/681 |
| 6,060,701 A | * | 5/2000 | McKee et al. | 219/681 |

FOREIGN PATENT DOCUMENTS

JP 402298729 A 12/1990

OTHER PUBLICATIONS

International Search Report dated Nov. 16, 2001 for International Application No. PCT/US01/41292 filed on Jul. 6, 2001.

* cited by examiner

*Primary Examiner*—Philip H. Leung
(74) *Attorney, Agent, or Firm*—Ohlandt, Greeley, Ruggiero & Perle, LLP

(57) ABSTRACT

A combination convection/microwave oven in which a food product is cooked by microwave energy from a source thereof and by a heated airflow provided by a thermal energy source and a blower. The food product is located in the near field of the microwave energy. The oven includes a controller that operates the thermal energy source and/or the blower according to temperature and or time to improve cooking results. The cooking procedure includes a soak interval during which the thermal energy source, the blower and/or the microwave energy source is turned off, whereby the temperature of the food product is permitted to equilibrate and thereby provide more uniform cooking. The food product may be located directly on the rack or in a microwave transparent or reflective container.

3 Claims, 5 Drawing Sheets

COMBINATION CONVECTION/ MICROWAVE OVEN CONTROLLER

BACKGROUND OF THE INVENTION

1. Field of the Invention

This invention relates to a combination convection/ microwave oven and, in particular, to a convection/ microwave oven with a controller and method for controlling a cook cycle of the oven.

2. Description of the Prior Art

Ovens that use both microwave energy and thermal energy transferred by convection are described in U.S. Pat. Nos. 4,358,653, 4,392,038, 4,410,779 and 4,430,541. For example, U.S. Pat. No. 4,430,541 discloses an oven having a source of microwave energy disposed in a bottom of the oven's cooking chamber and a blower arranged in a side wall to produce a heated airflow. A food product in a container is situated above the microwave source and in the path of the heated airflow. The container is microwave transparent in order to have as much as possible of the microwave energy directly impinge upon the food product. In ovens of this type, the container is positioned in the microwave energy pattern so that substantially all of the microwave energy is incident on the bottom of the container.

Microwave energy can thaw and cook food products rapidly, but it generally does not provide surface finishing, browning, or other characteristics provided by cooking in an oven environment. Accordingly, microwave ovens with added thermal convection energy have become popular in the restaurant industry. When prior art combination convection/microwave ovens have been used to cook frozen food products, such as biscuits, pies and other bakery goods, dark spots and other non-uniformities often form on the food product. Food products with dark spots are unsightly and, therefore, unpalatable to customers.

The dark spots are formed due to non-uniform energy transfer to and within the food product during the cooking process. The temperature of a frozen food product, for example, can be non-uniform due to conditions existing in the freezer, to non-uniformity of the food product itself, to the package that contains the food product and/or to conditions that occur in the oven. When thawing and/or cooking a frozen food product in prior art ovens, the bottom of the product is warmed by the direct impingement of the microwave energy. However, the top and sides of the food product are being warmed by the heated airflow. The frozen food product cools the heated airflow so as to affect the cooking or thawing temperature of the top and sides. This effect is known as the chill factor as it is similar to the wind chill factor produced by wind on a cold day. As the food product continues to thaw and then to cook, the sides and top remain cooler than the bottom and, thus, enhance the formation of the dark spots or other indications of non-uniform cooking.

Additionally, prior art combination convection/ microwave ovens require the use of microwave transparent cooking containers, such as those made with ceramic or glass. This reduces the flexibility of means of thermal transfer and may affect the characteristics of the cooked products.

Thus, there is a need for a combination convection/ microwave oven that can rapidly thaw, cook and possibly brown food products with increased uniformity of interior and exterior properties.

SUMMARY OF THE INVENTION

A combination microwave and convection oven of the invention cooks a food product with microwave energy from a source of microwave energy and by a heated airflow that is produced by a thermal energy source and a blower. A controller operates the microwave energy source, the thermal energy source and the blower to cook the food product in a cook cycle. The controller includes a processor that performs a procedure that turns the microwave energy source, the thermal energy source and the blower on and off during the cook cycle according to either temperature of the heated airflow or time within the cook cycle.

According to an aspect of the invention, the procedure includes a soak interval during which the thermal energy source and/or the blower is turned off and the microwave source is either turned on or off, thereby allowing temperature within the food product to equilibrate. The soak interval can occur at any point in the cook cycle.

According to another aspect of the invention, the food product can be situated in a microwave reflective pan that is held on a rack by a rack suspension system at a height h above the microwave energy source. The height h is selected so that the microwave reflective container is in the near field of the microwave energy, whereby the food product is cooked by reflected microwave energy and convection of the heated airflow. This aspect provides additional cooking flexibility, as there is no requirement for microwave transparent cooking containers.

BRIEF DESCRIPTION OF THE DRAWING

Other and further objects, advantages and features of the present invention will be understood by reference to the following specification in conjunction with the accompanying drawings, in which like reference characters denote like elements of structure and.

DESCRIPTION OF THE INVENTION

Figure 1:
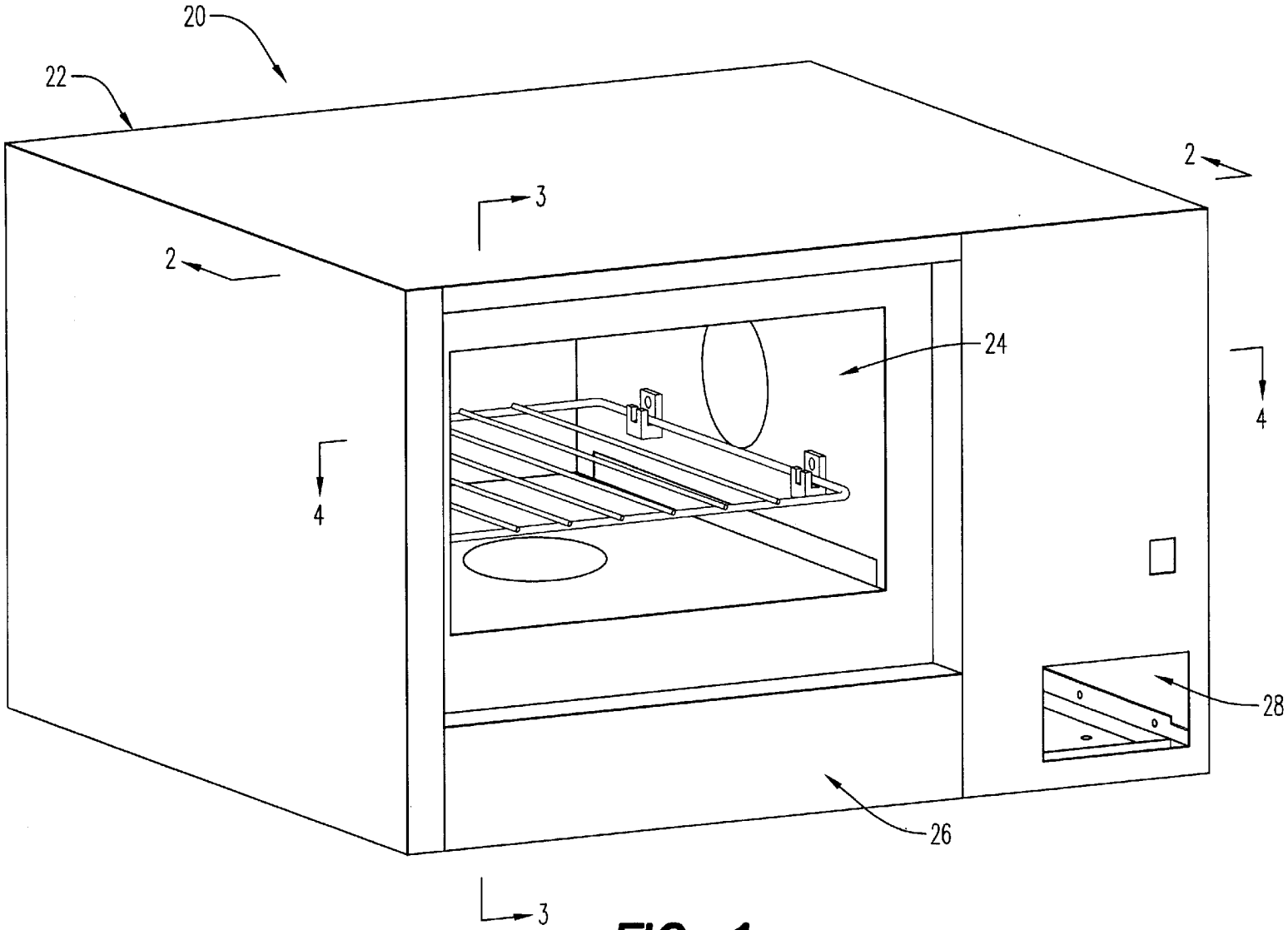
FIG. 1 is a perspective view of a combination convection/ microwave oven of the present invention.
Figure 2:
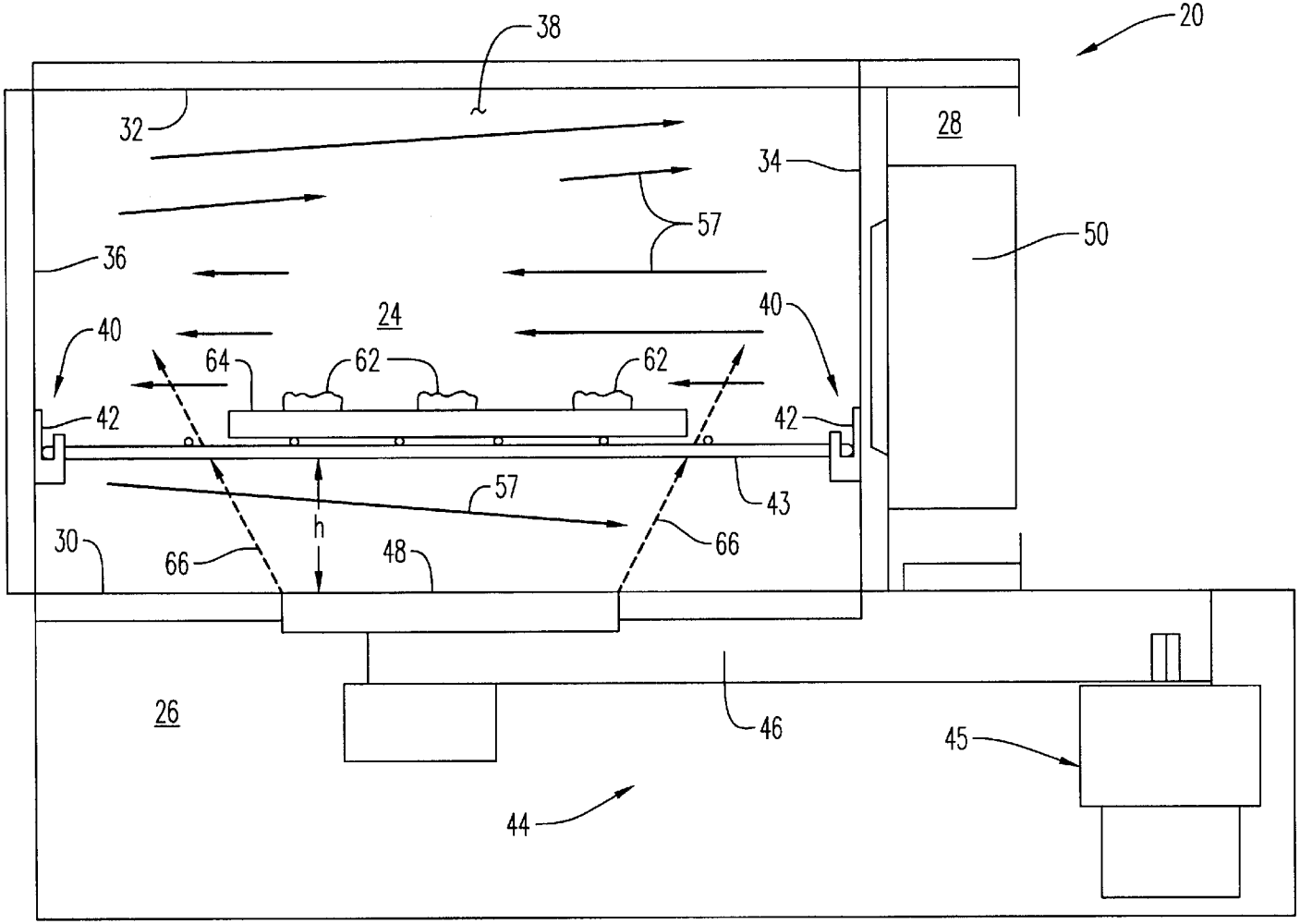
FIG. 2 is a view along line 2—2 of FIG. 1.

Referring to FIGS. 1 and 2, an oven 20 has an enclosure 22 that houses a cooking chamber 24, a bottom chamber 26 and a side chamber 28. Cooking chamber 24 includes a bottom 30, a top 32, a pair of sides 34 and 36 and a back 38. A rack suspension system 40 includes brackets 42 that are mounted to sides 34 and 36. Rack suspension system 40 holds a rack 43 at a height h above bottom 30.

Figure 4:
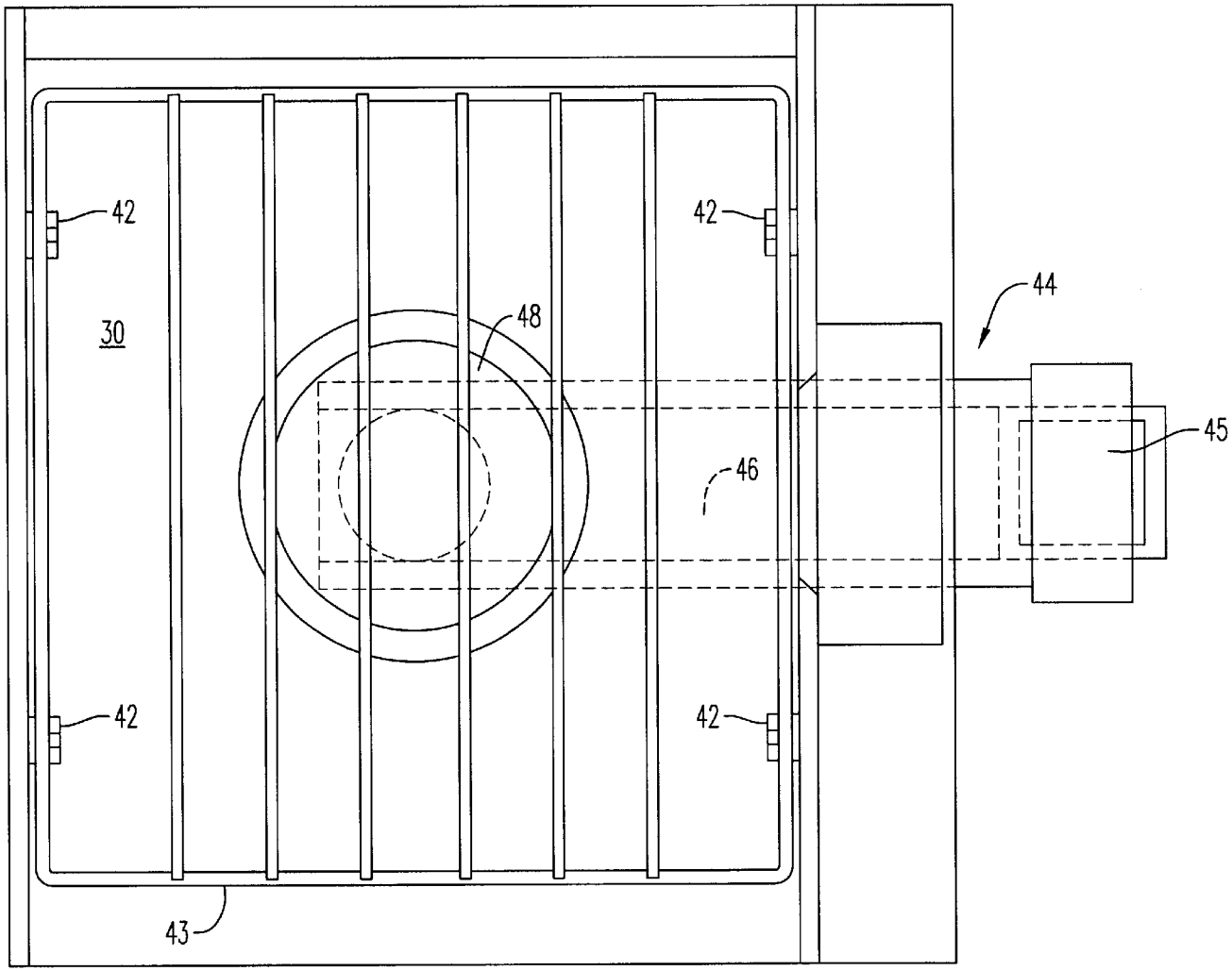
FIG. 4 is a view along line 4—4 of FIG. 1.

Referring to FIGS. 2 and 4, bottom chamber 26 contains a source of microwave energy 44 that includes a microwave emitter 45 and a wave guide 46 for directing microwave energy from microwave emitter 45 to cooking chamber 24 via an opening 48 in bottom 30.

Figure 3:
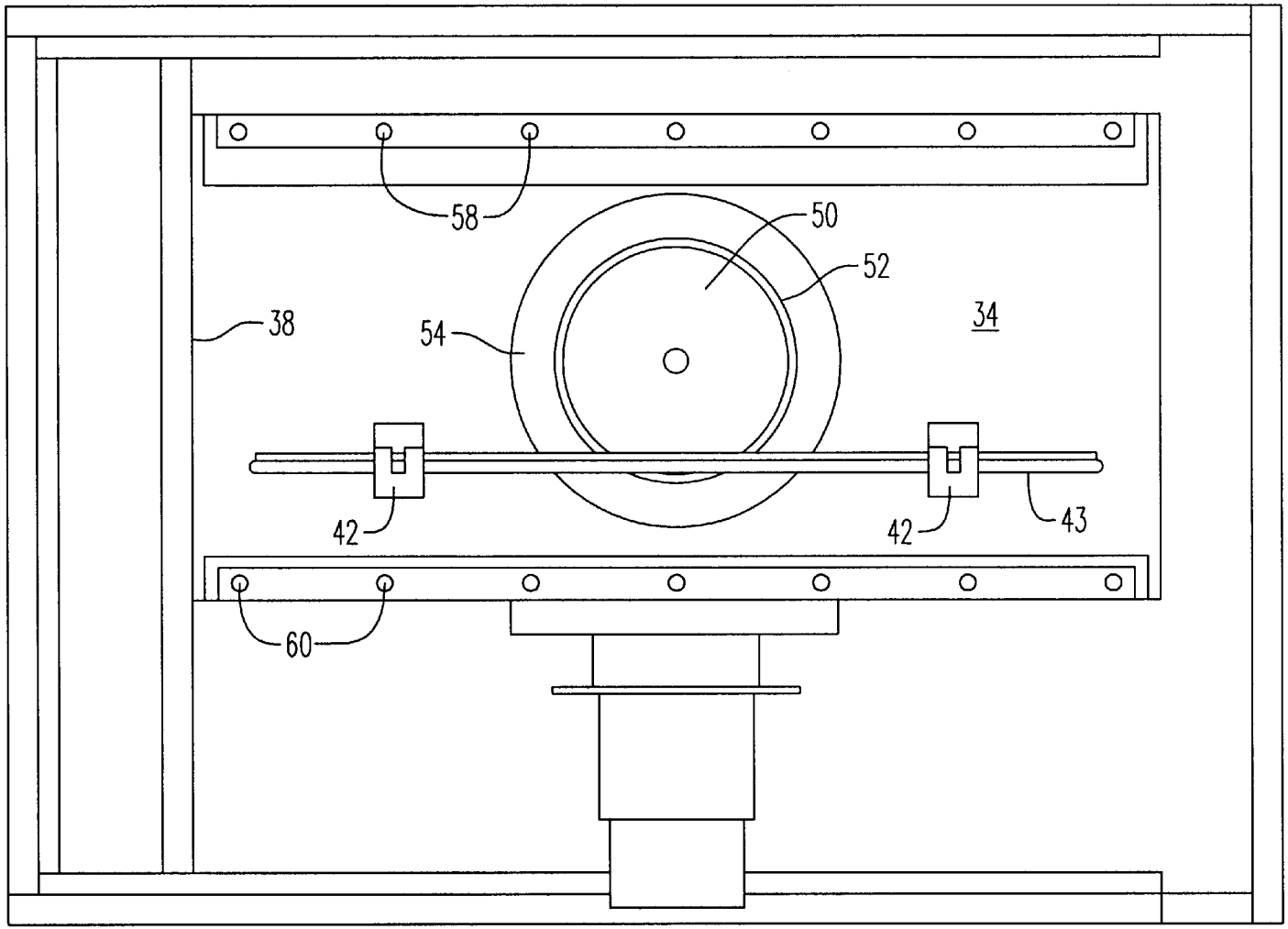
FIG. 3 is a view along line 3—3 of FIG. 1.

Referring to FIGS. 2 and 3, a blower 50 is mounted in side chamber 28 to blow a heated airflow 57 (solid arrows in FIG. 2) into cooking chamber 24 via an opening 52 in side 34 thereof. In particular, blower 50 is mounted to side 34 with a mounting plate 54 and suitable fasteners (not shown). Blower 50 includes a thermal energy source or heater 56 (shown only in FIG. 5) to heat airflow 57.

Heated airflow 57 travels across cooking chamber 24 and is reflected by side 36 back to upper return ports 58 and lower return ports 60 in side 34. Heated airflow 57 heats by convection the sides and tops of food products 62 contained in a shallow pan or other cooking container 64 situated on rack 43. Alternatively, in the case of some food products, such as pizza, food products 62 can be cooked directly on rack 43. Food products 62, may be any food product. However, the invention is especially suitable for cooking frozen food products, such as bakery products like biscuits, buns, muffins, pizzas, pies and the like.

Microwave energy 66 (dashed arrows in FIG. 2) is directed upward from opening 48 in bottom 30 in a generally cone shaped pattern. Whether cooking with or without pan 64, microwave energy 66 is reflected by top 32, sides 34 and 36, back 38 and bottom 30 of cooking chamber 24 to impinge upon food products on their sides and tops.

A feature of the invention is that pan 64 can be either microwave transparent or reflective (e.g., metallic) and held by rack suspension system 40 on rack 43 in the near field of microwave energy 66. That is, the location or height h of pan 64 is selected so that pan 64 is within the generally conical pattern. If a microwave reflective pan is used, microwave energy 66 is both reflected by the bottom of pan 64 and also directed by the edges of pan 64. Microwave energy 66 also heats the bottom of pan 64, which transfers the heat to the bottoms of food products 62.

It has been discovered that the height h from the top of microwave energy source 44 to the top of rack 43 is important for cooking with a microwave reflective pan. The height h should be in the range of about 2.5 inches to about 3.5 inches, more preferably about 2.75 inches to about 3.25 inches, and most preferably about 2.875 inches.

Figure 5:
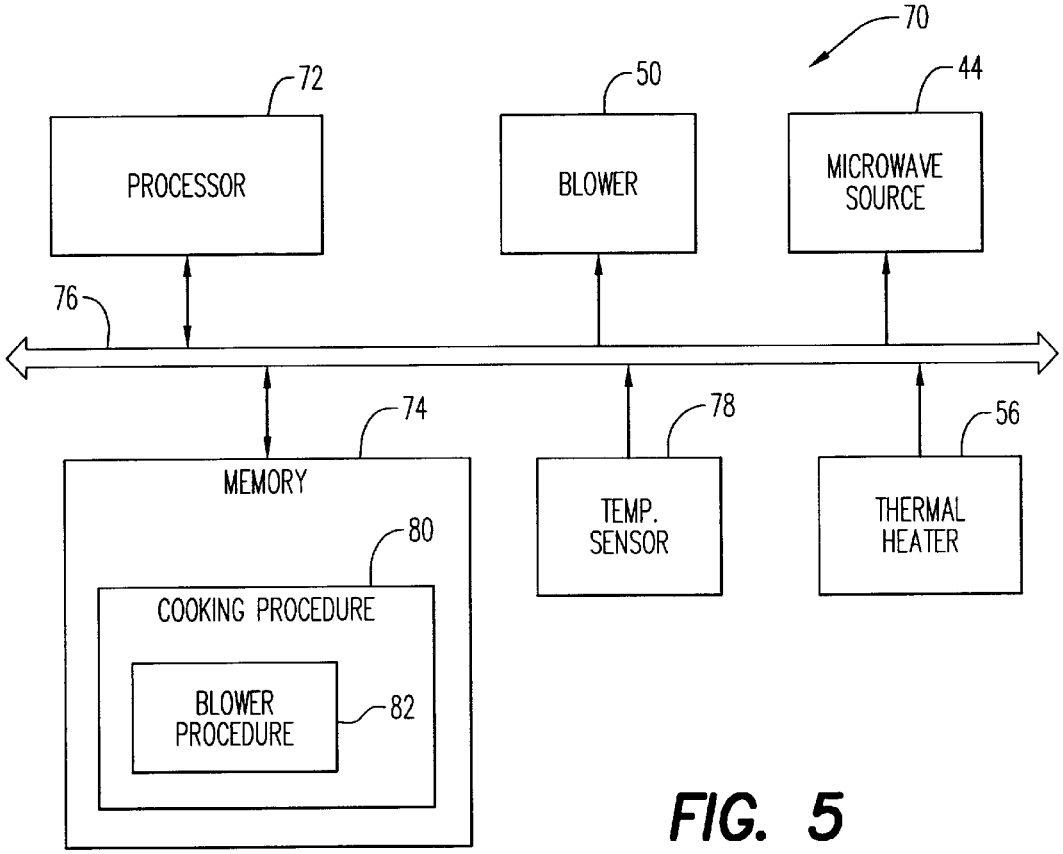
FIG. 5 is a block diagram of the controller of the oven of FIG. 1.

Referring to FIG. 5, a controller 70 includes a processor 72 and a memory 74 interconnected by a computer bus 76. Blower 50, microwave source 44, thermal heater 56 and a temperature sensor 78 are also interconnected with processor 72 via computer bus 76. Temperature sensor 78 may, for example, be located in cooking chamber 24 or in side chamber 28 to sense the temperature of the heated airflow 57.

Memory 74 includes a cooking procedure 80 that is executed by processor 72 to control the cooking of food products 62. To this end, cooking procedure 80 causes processor 72 to operate blower 50, thermal heater 56 and microwave source 44 according to a selected cooking process. In prior art cooking processes, blower 50 has been operated continuously over the cook cycle of the cooking process, while microwave source 44 has been operated to control the intensity of microwave energy 66 throughout the cooking process.

It has been discovered that the cooking process is improved by a blower procedure 82 that is executed with cooking procedure 80 so as to control the thermal characteristics of the convection heat. This is accomplished by synchronizing thermal heater 56 and blower 50 and controlling them with temperature and/or time. Thus, the temperature and intensity of airflow 57 can be controlled to have a gentler effect on food products 62. Blower procedure 82 is particularly suited to the cooking of frozen food products to control and make the temperature of food products 62 more uniform during the cook cycle. For example, the chill factor can be controlled by the intensity or velocity of airflow 57.

An aspect of blower procedure 82 is a soak interval that is a period of time during the cook cycle in which blower 50 is turned off. Also, microwave energy source 44 can be turned off during the soak cycle, independently and alternatively with turning off the thermal energy source 56 or blower 50. The soak interval occurs after food products 62 have been cooked with microwave energy 66 and heated airflow 57 for a portion of the cook cycle. During the soak interval, the temperature within food products 62 equilibrates or becomes more uniform. The soak interval has been found to substantially eliminate the formation of dark spots on bakery products.

Figure 6:
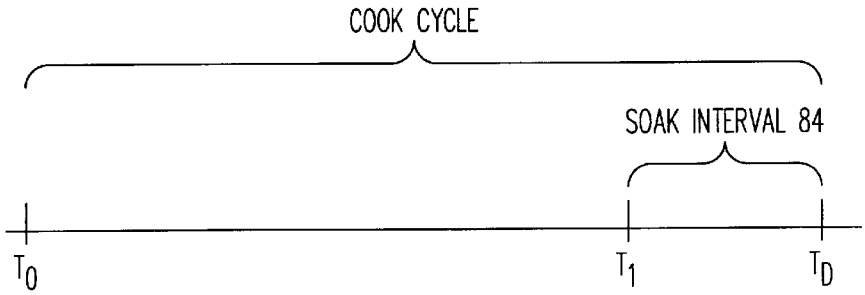
FIGS. 6 and 7 depict cook cycles of the oven of FIG. 1.

A cooking procedure 80 that utilizes blower procedure 82 is illustrated by the time diagram depicted in FIG. 6. The cook cycle is from time $T_0$ to time $T_D$. From $T_0$ to a time $T_1$, microwave source 44, blower 50 and thermal heater 56 are operated to continuously heat food products 62 by convection and radiated microwave energy. At $T_1$ a soak interval 84 begins and continues to time $T_D$. Blower 50 and thermal heater 56 are turned off during soak interval 84. Microwave source 44 can either be on or off during soak interval 84.

Figure 7:
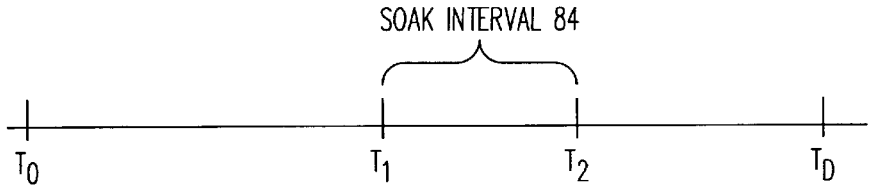

Soak interval 84 can be inserted at various points in the cook cycle. For example, FIG. 6 shows soak interval positioned to end at time $T_D$. As another example, FIG. 7 shows soak interval 84 positioned to end at a time $T_2$ that is prior to time $T_D$.

The present invention having been thus described with particular reference to the preferred forms thereof, it will be obvious that various changes and modifications may be made therein without departing from the spirit and scope of the present invention as defined in the appended claims.

What is claimed is:

1. A combination microwave and convection oven in which a food product situated on a rack is cooked by energy from a microwave energy source and by a heated airflow that is produced by a thermal energy source and a blower, said microwave energy source being disposed in a bottom of the oven below said rack, said oven comprising:

a support means that holds said rack in the near field of said microwave energy, whereby said food product is cooked by direct and reflected microwave energy and convection of the heated airflow, wherein said support means holds said rack at a height in a range of about 2.5 inches to about 3.5 inches above a top of said microwave energy source.

2. The oven of claim 1, wherein said height is about 2.875 inches.

3. The oven of claim 1, wherein said food product is situated in a microwave reflective pan on said rack.

* * * * *